US005297981A

United States Patent [19]

Maxim et al.

[11] Patent Number: 5,297,981

[45] Date of Patent: Mar. 29, 1994

[54] SELF-PROPELLED BOUNCING BALL

[75] Inventors: John Maxim, Danbury, Conn.; Christopher Thompson, Garnavillo; Mark F. Reyner, Oelwein, both of Iowa

[73] Assignee: The Ertl Company, Inc., Dyersville, Iowa

[21] Appl. No.: 13,762

[22] Filed: Feb. 4, 1993

[51] Int. Cl.[5] ..... A63H 17/00; A63H 29/00; A63H 29/02

[52] U.S. Cl. ..... 446/437; 446/458; 446/462; 273/58 K

[58] Field of Search ..... 446/437, 431, 448, 454, 446/457, 458, 461, 462, 463, 484; 273/58 K, 58 F, 58 G, 58 H

[56] References Cited

U.S. PATENT DOCUMENTS

| | | | |
|---|---|---|---|
| D. 301,161 | 5/1989 | Dunse . | |
| 725,011 | 4/1903 | Richards . | |
| 744,718 | 11/1903 | Cassidy | 273/58 K |
| 1,033,077 | 7/1912 | Ayers, Jr. . | |
| 2,939,246 | 6/1960 | Glos, II . | |
| 2,949,696 | 8/1960 | Easterling . | |
| 2,949,697 | 8/1960 | Licitis et al. . | |
| 2,977,714 | 4/1961 | Gibson . | |
| 3,453,773 | 7/1969 | Compton et al. . | |
| 3,500,579 | 3/1970 | Bryer . | |
| 3,667,156 | 6/1972 | Tomiyama et al. . | |
| 3,798,835 | 3/1974 | McKeehan . | |
| 4,057,929 | 11/1977 | Ogawa . | |
| 4,471,567 | 9/1984 | Martin . | |
| 4,501,569 | 2/1985 | Clark, Jr. et al. . | |
| 4,541,814 | 9/1985 | Martin . | |
| 4,726,800 | 2/1988 | Kobayashi | 446/458 |
| 5,028,053 | 7/1991 | Leopold | 273/58 K |
| 5,045,013 | 9/1991 | Fujitani | 446/462 X |

FOREIGN PATENT DOCUMENTS

| | | | |
|---|---|---|---|
| 2705064 | 8/1978 | Fed. Rep. of Germany | 273/58 K |
| 8803308.2 | 4/1988 | Fed. Rep. of Germany . | |
| 2125754 | 9/1972 | France . | |
| 2585255 | 1/1987 | France | 273/58 K |
| 1674881 | 9/1991 | U.S.S.R. | 273/58 K |
| 470974 | 11/1936 | United Kingdom | 446/458 |
| 470974 | 8/1937 | United Kingdom . | |

OTHER PUBLICATIONS

European Search Report dated Aug. 23, 1993.

*Primary Examiner*—David N. Muir

*Attorney, Agent, or Firm*—Marshall, O'Toole, Gerstein, Murray & Borun

[57] ABSTRACT

A toy ball in accordance with this invention includes a hollow sphere with spaced apart resilient knobs extending outwardly from the sphere and an internal mechanism that causes a random motion and bouncing of the ball. A safety switch is also provided to prevent injury to a user or damage to the toy while it is disassembled.

34 Claims, 4 Drawing Sheets

SELF-PROPELLED BOUNCING BALL

BACKGROUND OF THE INVENTION

The present invention relates generally to a toy ball having an internal motor and resilient knobs on its surface that act in combination to cause random movement and bouncing of the ball. The toy ball also contains a safety switch that prevents the motor from operating when the ball is disassembled.

A number of toy self-propelled balls have been developed and patented that include internal battery-operated motors. Other balls have incorporated resilient knobs on their outer surfaces to cause random rolling.

SUMMARY OF THE INVENTION

A toy ball in accordance with the present invention provides a novel and safe alternative to the balls previously developed. The self-propelled bouncing ball comprises a hollow sphere having interlocking first and second hemispheres, a number of spaced apart resilient knobs joined to and extending outwardly from the hollow sphere, and rotating means for randomly propelling the ball across a play surface, the rotating means being mounted inside the sphere.

The ball may also have safety means for preventing activation of the rotating means unless the first and second hemispheres are interlocked. A safety switch may be used to deactivate the rotating means. A safety switch and a power switch may be provided which must both be closed to activate the rotating means.

The rotating means may rotate about a fixed axle and include a battery powered motor, a drive shaft rotatably joined to the motor, a drive gear fixed to the drive shaft, a large transmission gear meshed with the drive gear, a small transmission gear fixed coaxially to the large transmission gear and a stationary gear fixed to the axle and meshed with the small transmission gear.

A self-propelled bouncing ball in accordance with the present invention may also include a hollow sphere having interlocking first and second hemispheres, a number of spaced apart resilient knobs joined to and extending outwardly from the sphere, a fixed axle having first and second ends fixed to the first hemisphere near where the first hemisphere interlocks with the second hemisphere, an electric motor rotationally mounted on said axle and spaced apart from the first end of the axle, drive means for rotating the motor about the axle, and safety means for deactivating the electric motor, the safety means being positioned between the first end of the axle and the motor.

The safety means may include a normally open switch that may be closed when the first and second hemispheres are interlocked.

The electric motor may have a center of gravity that is offset from the axle. The drive means may comprise a drive shaft rotatably joined to the motor, a drive gear fixed to the drive shaft, a large transmission gear meshed with the drive gear, a small transmission gear fixed coaxially to the large transmission gear and a stationary gear fixed to the axle and meshed with the small transmission gear.

A self-propelled bouncing ball may also include a hollow sphere having interlocking first and second hemisphere, a plurality of spaced apart resilient knobs joined to and extending outwardly from the hollow sphere, an axle having first and second ends fixed to the first hemisphere near where it interlocks with the second hemisphere, an electric motor rotatably mounted on the axle and spaced apart from the first end of the axle, drive means for rotating the motor about the axle, a moveable spring contact in communication with the electric motor having a first position to deactivate the electric motor and a second position to enable the motor to be activated, and means for depressing the moveable spring contact between the first and second positions, the means being slidably mounted on the axle between the first axle end and the motor.

The means for depressing the moveable spring contact may have a coil spring slidably mounted on the axle adjacent the motor and a cylinder slidably mounted on the axle between the coil spring and the first end of the axle, the cylinder being capable of assuming first and second positions. A tab means mounted on the second hemisphere may be provided for moving the cylinder between the first and second positions.

The hollow sphere may be rigid or semi rigid and may have resilient or plush coverings. The resilient knobs may be sized and spaced to prevent the sphere from contacting a flat surface. The knobs may be truncated cones and may be rotational molded poly-vinyl chloride having a durometer resiliency reading in the range of Shore A 60–65.

Other features and advantages are inherent in the ball claimed and disclosed or will become apparent to those skilled in the art from the following detailed description in conjunction with the accompanying diagrammatic drawings.

DETAILED DESCRIPTION OF THE INVENTION

Figure 1:
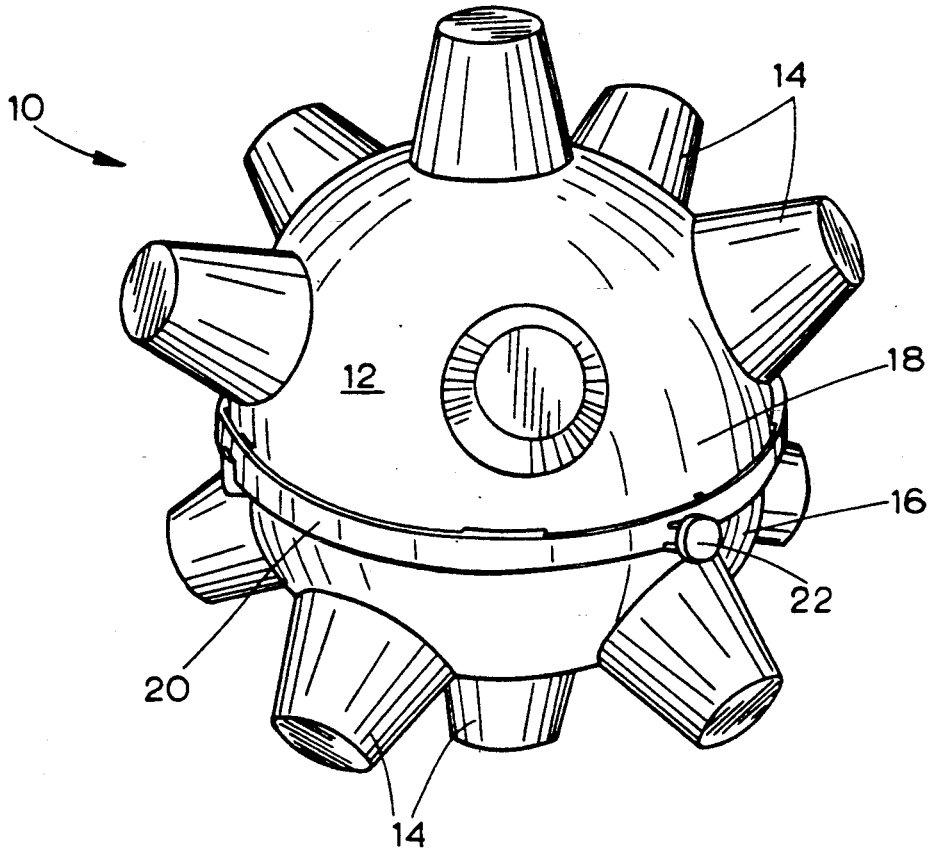
FIG. 1 is a perspective view of a self-propelled bouncing ball in accordance with the present invention.

Referring to FIG. 1, indicated generally by 10 is a self-propelled bouncing ball comprising a sphere 12 and a plurality of resilient knobs 14 in the shape of truncated cones. The sphere 12 is hollow and is formed by a first hemisphere 16 interlocked with a second hemisphere 18. An interlocking mechanism is generally indicated at 20 (described more fully below) to hold first and second hemispheres 16 and 18 together. A push-pull power switch 22 is accessible from the outside of sphere 12.

Resilient knobs 14 are intended to cause ball 10 to move randomly and bounce about a play surface during operation, and are preferably sized and spaced apart to distances that will support sphere 12 above a flat surface taking into account the depression of resilient knobs 14 under the weight of ball 10 during operation.

A preferred knob arrangement is illustrated in FIGS. 1 through 4. Each hemisphere 16 and 18 has six equally spaced-apart knobs 14. If sphere 12 were four and one-half inches in diameter, knobs 14 would be equally spaced apart if five were positioned about one inch from the periphery of each hemisphere and a sixth knob were in the middle. With this arrangement, sphere 12 would be supported above a flat surface by three, one inch knobs spaced about two and one-half inches apart when ball 10 is stationary and in any orientation.

Further, it has been determined that optimum play value is realized when knobs 14 are truncated cones about one and one eighth inches in diameter at their bases and about three-quarters of an inch in diameter at their extremities, and are made of rotational molded polyvinyl. chloride (pvc) having a durometer resiliency measurement in the range of Shore A 60–65. Truncated pvc cones in this range resulted in a self-propelled bouncing ball that bounced about one-half to three-quarters of an inch above a play surface, appealed to children of preschool age, and resulted in optimum properties for battery life, current drain, voltage drop and motor temperature rise.

Knobs 14 may also be formed in the shape of stylized feet, hands or arms or there may be suction cups attached to some or all of their extremities to cause the ball 10 to stop momentarily from time to time.

Sphere 12 may be rigid to provide durability and adequate support for the internal rotational mechanism or sphere 12 may be made of a semirigid shell made of polyethylene or expanded foam polyurethane and covered with rotational molded pvc, foamed polyurethane or a plush material. These same coverings may also be applied over a rigid shell made of A.B.S, impact modified polystyrene.

Figure 2:
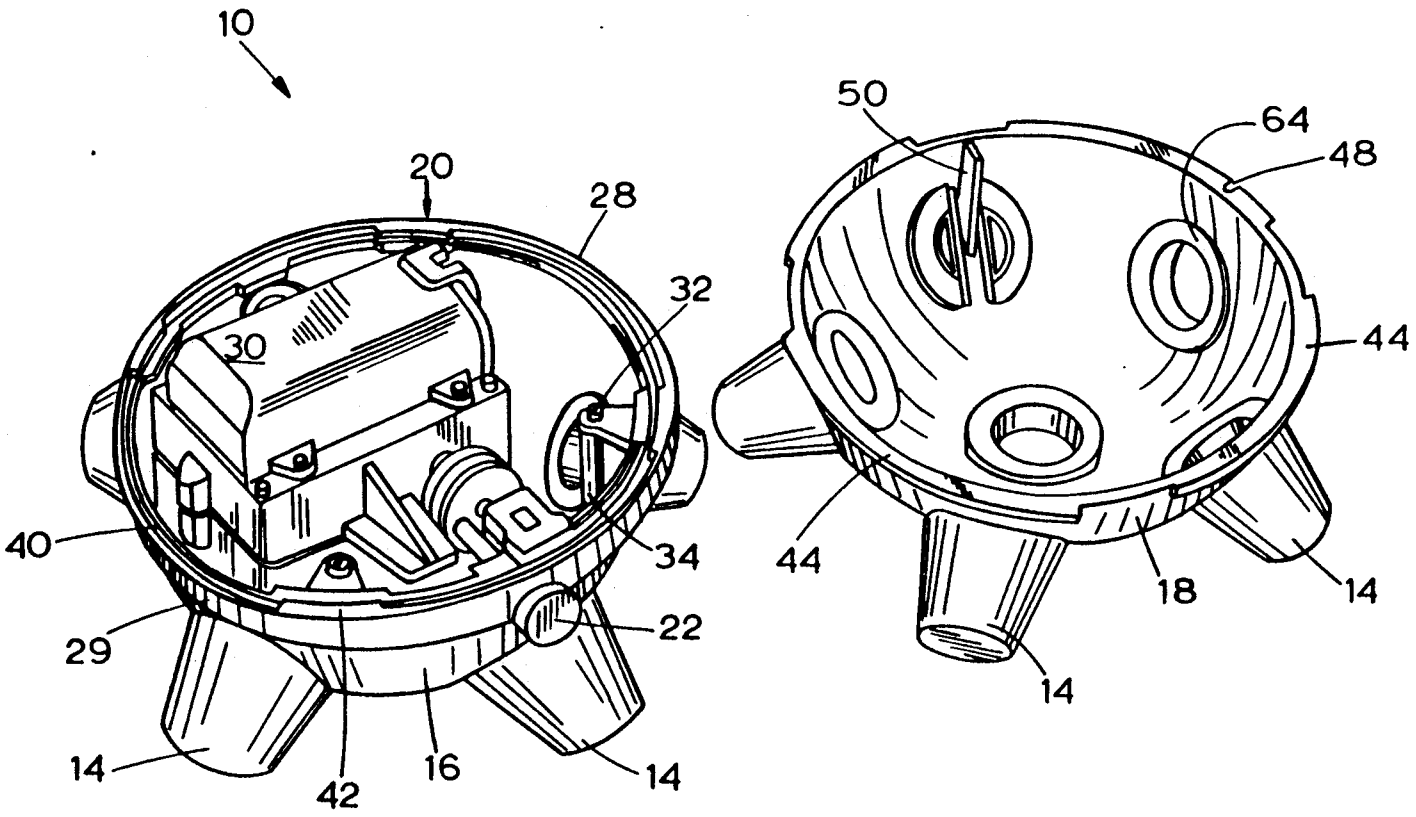
FIG. 2 is a perspective view of the ball in FIG. 1 disassembled to show the two hemispheres that make up the ball and its internal battery operated motor.

FIG. 2 illustrates self-propelled bouncing ball 10 disassembled to illustrate first hemisphere 16 and second hemisphere 18. First hemisphere 16 supports, among other things, an electric motor housing 30, and power switch 22.

Also illustrated in FIG. 2 is interlocking mechanism 20 which includes a rim 28 that surrounds the periphery of first hemisphere 16 and is mounted with screws 32 to posts 34 molded integrally with first hemisphere 16. Rim 28 has an outer smooth circular surface 29 having a slightly greater radius than the periphery of first hemisphere 16. Within the surface there is defined a series of four recesses 40 spaced apart by four flanges 42 designed to engage and interlock with four flanges 44 molded integrally with and extending outwardly from the periphery of second hemisphere 18.

First and second hemispheres 16 and 18 are interlocked by placing their peripheries adjacent one another and inserting flanges 44 on second hemisphere 18 into the recesses 40 and then rotating first and second hemispheres 16 and 18 in opposite directions until flanges 44 on second hemisphere 18 slide under and engage flanges 42 on first hemisphere 16 to interlock the two hemispheres. A first stop (not illustrated) is molded on one of the flanges on second hemisphere 18 to prevent the hemispheres from rotating completely through the engagement of their respective flanges. The resulting interlocking mechanism 20 is snug and appears as a smooth exposed surface 29 around the circumference of sphere 12 which does not interfere with the play value of the toy.

Also illustrated in FIG. 2 is an upwardly extending tab 50 in second hemisphere 18 that engages a safety switch (illustrated in FIGS. 3 and 4) in first hemisphere 16. The interaction of tab 50 with the safety switch is important because they must engage when first and second hemispheres 16 and 18 are interlocked before ball 10 becomes operable, as will be described in detail below. To ensure that the safety switch and tab 50 engage, molded lines on first and second hemispheres 16 and 18 are aligned when the two hemispheres are brought adjacent one another prior to being rotated to an interlocking position. Further, a second stop (not illustrated) is molded integrally with a flange 44 on second hemisphere 18 to prevent the hemispheres from being rotated in the wrong direction. Further, a screw may be inserted through rim 28 and into a recess on one of the flanges 44 of second hemisphere 18 to ensure sphere 12 does not disassemble during operation.

Figure 4:
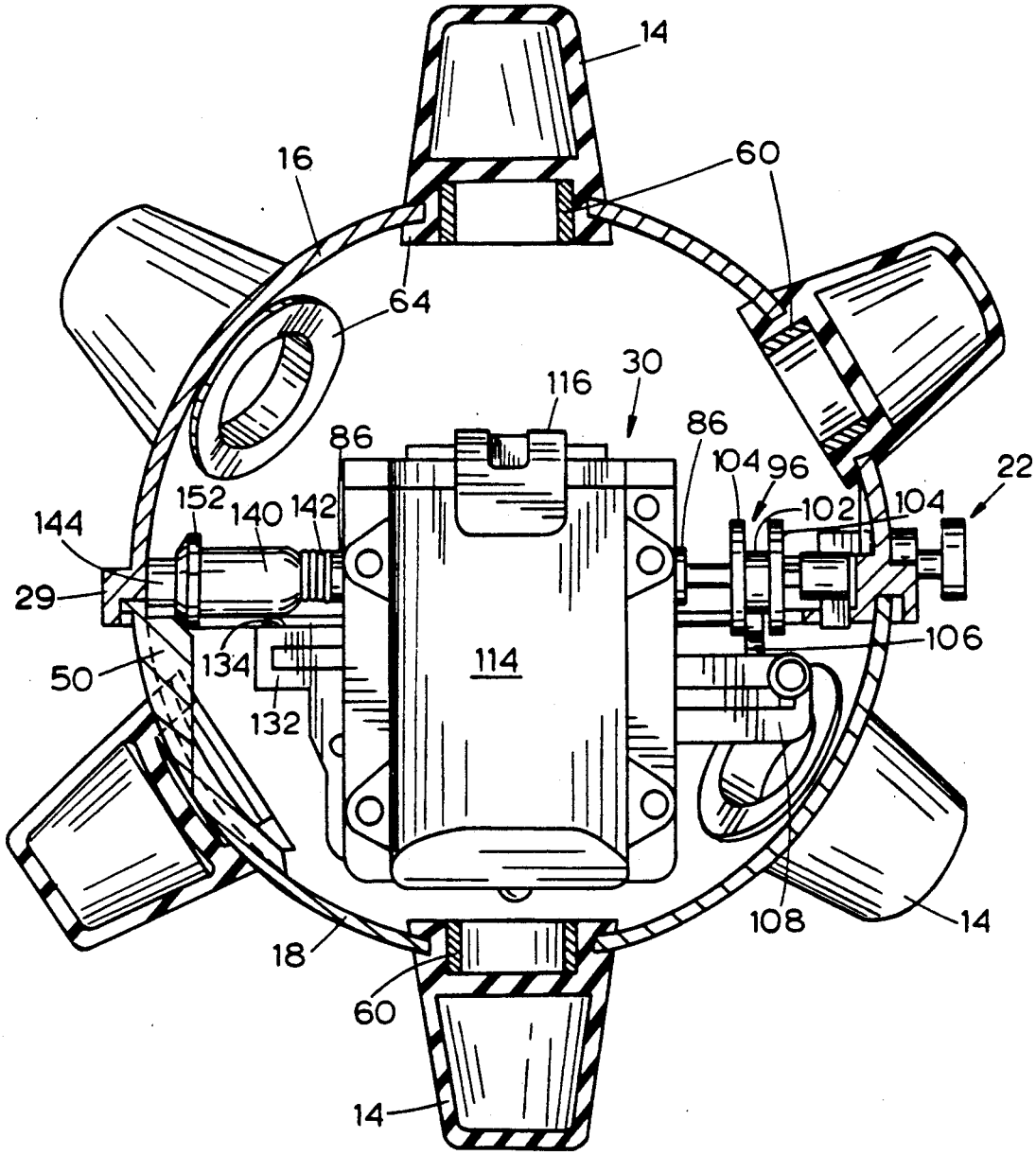
FIG. 4 is a cut-away plan view of the ball with a first hemisphere on the bottom and a second hemisphere on the top and also illustrating the safety switch in a second, closed position.

Also illustrated in FIG. 2, as well as FIG. 4, is the manner in which knobs 14 are secured to sphere 12. As best viewed in second hemisphere 18, resilient knobs 14 have at their bases, integrally molded flanges 64 that are pushed through holes in sphere 12. Rigid compression rings 60 (illustrated in cross-section in FIG. 4) are inserted in a hollow portion of knobs 14 to prevent knobs 14 from pulling out during use. Rigid compression rings 60 may also be glued to knobs 14 for durability.

Figure 3:
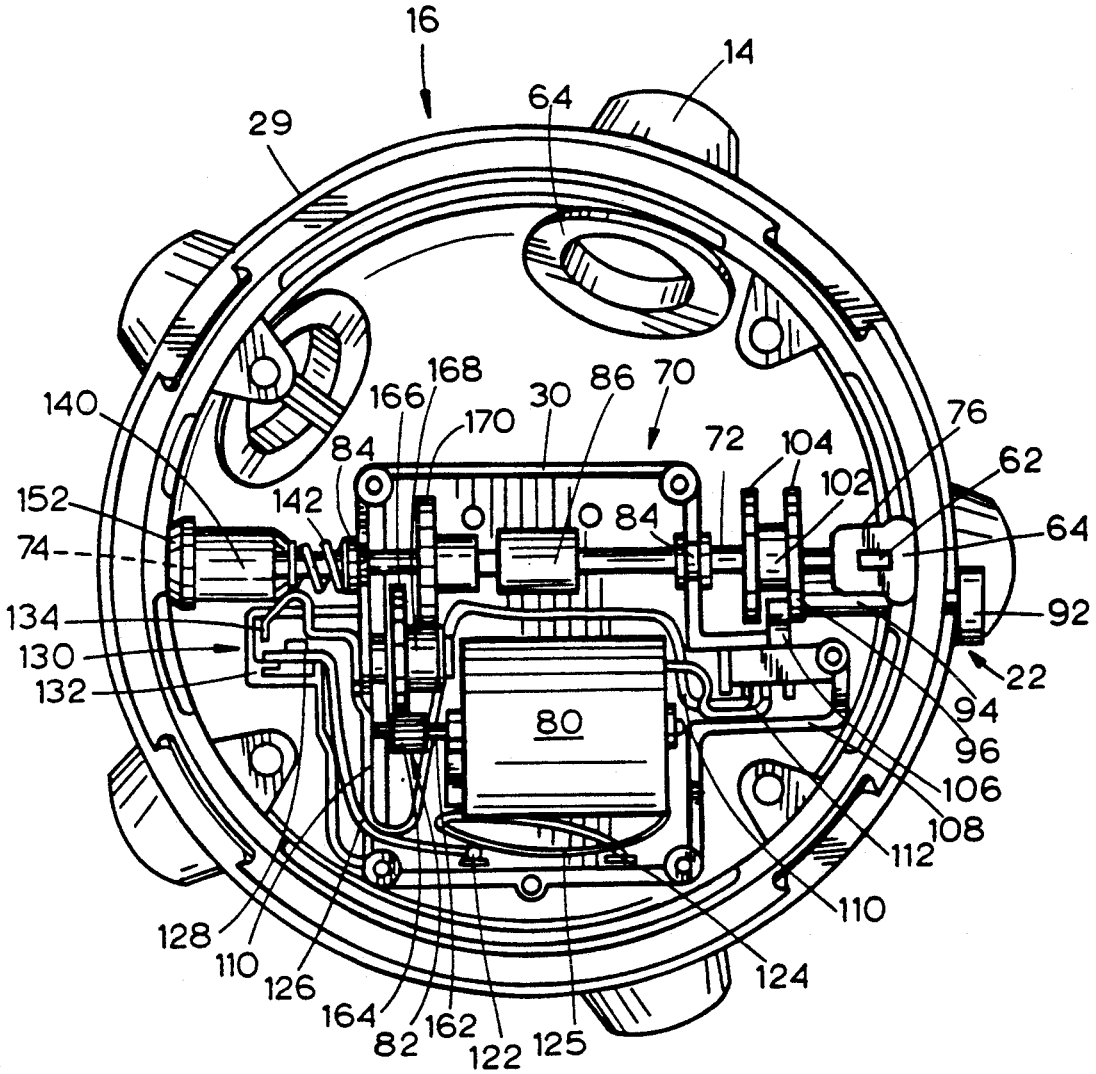
FIG. 3 is a plan view of a first hemisphere supporting the battery operated motor and switches with the motor housing cover removed and illustrating a safety switch in a first, open position.

FIG. 3 illustrates a rotating mechanism 70 for randomly propelling ball 10. An axle 72 spans the diameter of first hemisphere 16. Axle 72 has a first end 74 on the left and a second end 76 on the right. Axle 72 is fixed to first hemisphere 16 to prevent rotation by use of a key 62 fixed to second axle end 76 and inserted in a slot in tab 64 and a protruding slot (not illustrated) molded on first hemisphere 16.

Housing 30 contains a battery-powered motor 80 and drive mechanism 82. Housing 30 is rotatably mounted on axle 72 in such a manner as to offset the center of gravity of motor 80, housing 30, and batteries (not illustrated) from axle 72. Friction between housing 30 and axle 72 is reduced by plastic sleeve bearings 84. A restraining collar 86 is fixed to axle 72 and is supported by a frame (not illustrated) in housing 30, to prevent housing 30 from sliding between first and second ends 74 and 76 of axle 72.

Power switch 22 illustrated on the right hand side of first hemisphere 16 includes a rim 92 molded integrally with a shaft 94 and an internal spool 96. Shaft 94 extends from rim 92 to spool 96 through an opening in first hemisphere 16. Spool 96 is slidably mounted on axle 72 near second end 76. Spool 96 is essentially a cylinder 102 with two spaced apart rims 104.

A sliding switch 106 is positioned between rims 104 of spool 96. Sliding switch 106 is mounted on right housing arm 108 and is able to slide from left to right. This arrangement between spool 96 and sliding switch 106 enables housing 30 to rotate about axle 72 while sliding switch 106 rotates between rims 104 of spool 96 which does not rotate.

To move sliding switch 106 from left (closed position illustrated in FIG. 3) to right (open position illustrated in FIG. 4) and vice versa, the user merely pushes or pulls power switch 22 in or out to cause spool rims 104 to push sliding switch 106 left or right to open or close the circuit, respectively. In closed position, electrical contacts (not illustrated) are closed to at least partially complete an electrical circuit having wire leads 110 and 112. Wire lead 110 connects sliding switch 106 with a safety switch described below. Wire lead 112 connects sliding switch 106 to motor 80.

Alternate power switch 22 arrangements may also be used including modified mechanical switch arrangements, sound or light activation means, or a position switch that would activate motor 80 only in certain random or predetermined orientations.

Motor 80 is preferably a Mabuchi toy motor of the RC 280 series and most preferably an RC280-RA-20120. Motor 80 is energized by four double A batteries (not illustrated). The batteries are all arranged vertically, two above and two below motor 80, as viewed in FIGS. 3 and 4. The batteries extend from the top to the bottom of housing 30 and ar electrically coupled to motor 80 via first and second terminals 122 and 124 near the bottom of housing 30. The batteries are contained within a battery cover 114 and are accessible through battery cap 116 both illustrated in FIG. 4.

Wire lead 125 connects first terminal 124 to motor 80 and wire lead 126 connects terminal 122 to a stationary contact 128 in a safety switch 130 mounted in a left housing arm 132. Moveable spring contact 134 is in a normally open (up) position extending through an opening in left housing arm 132 and may be made of copper, bronze, nickel-plated bronze, phosphor bronze, or other suitable material. Moveable spring contact 134 is connected to wire lead 110 which is in turn connected to sliding switch 106.

For current to pass through the illustrated electrical circuit it must originate from the batteries through first terminal 122, lead wire 126, safety switch 130, lead wire 110, sliding switch 106, lead wire 112, motor 80 and back to the batteries via lead wire 125 and second terminal 124. It is readily seen that both sliding switch 106 and normally open safety switch 130 must be closed to complete the circuit.

To close safety switch 130, moveable spring contact 134 must be depressed downward to contact stationary contact 128 that is riveted to left housing arm 132. A mechanism for depressing moveable contact 134 is slidably mounted on first end 74 of axle 72, and includes a cylinder 140 and a coil spring 142. Cylinder 140 is capable of sliding on axle 72 and is normally urged to first axle end 74 by spring 142. Cylinder 140 is preferably mounted on a low friction plastic bushing 144 that is fixed to first axle end 74 and which prevents axle 72 from punching through first hemisphere 16. (See FIG. 4). Coil spring 142 is positioned between cylinder 140 and restraining collar 86 to the left of housing 30. In this position cylinder 140 is not able to depress moveable contact 134 which results in an open, inoperative electrical circuit. When cylinder 140 is pushed to the right, it compresses coil spring 142 against collar 86, and due to its diameter, it depresses moveable spring contact 134 downward to close safety switch 130. (FIG. 4).

In order for cylinder 140 to be pushed to the right, first and second hemispheres 16 and 18 must be interlocked. The act of rotating the two hemispheres in opposite directions relative to one another (described above) causes tab 50 on second hemisphere 18 to engage a raised collar 152 on cylinder 140 thereby pushing cylinder 140 to the right and moveable spring contact 134 downward. To make this transaction smooth, the right edge of raised collar 152 and the inside corner of tab 50 are beveled. Further, the right end of cylinder 140 is rounded and moveable contact 134 is bent to form a ramp opposing the rounded end on cylinder 140. This enables the parts to easily slide into engagement as they change positions.

As described, safety switch 130 and cylinder 140 have two positions. In a first position, the electrical circuit is open and motor 80 is inoperable regardless of the position of power switch 22. In the first position, cylinder 140 is urged left toward first end 74 of axle 72 by coil spring 142, and moveable spring contact 134 is up and normally open safety switch is open.

In a second position, the electrical circuit is capable of being closed by power switch 22. In the second position, cylinder 140 is forced by tab 50 toward motor 80 and housing 30, and moveable spring contact 134 is forced downward by cylinder 140 to close safety switch 130.

This safety feature is important to prevent injuries to the user while batteries are being inserted into ball 10. If motor 80 were operable while hemispheres 16 and 18 are separated, power switch 22 could accidently be pushed and motor 80 activated, causing it to spin about axle 72 (described below) resulting in pinched fingers or in dropping first hemisphere 16 which could damage mechanism 70.

Once the circuit is closed, motor 80 converts the electrical energy of the batteries to mechanical energy and causes ball 10 to be randomly propelled through drive mechanism 82. Drive mechanism 82 includes a drive shaft 162 that is stabile because its left end and motor 80 are supported by housing 30. Drive shaft 162 has mounted on it a small drive gear 164. Drive gear 164 is meshed with a large transmission gear 166 that is rotatably mounted in housing 30. A small transmission gear 168 is fixed to the right of and coaxial with large transmission gear 166. Small transmission gear 168 is meshed with a large stationary gear 170 fixed to axle 72.

As a result of this arrangement, energizing motor 80 causes drive shaft 162 to rotate drive gear 164 which in turn rotates transmission gears 166 and 168. Because stationary gear 170 will not rotate, the mechanical energy of motor 80 spins housing 30 and the components it houses, up and over axle 72. As stated above, the center of gravity of this mechanism is offset from the axle, so housing 30 rises relatively slowly upward and then the combination of its weight and the operation of motor 80 causes it to flop relatively quickly downward. This variable acceleration of offset weight causes the movement of ball 10 to be somewhat random. The spacing of knobs 14 on the outside of sphere 12 enhances the random movement and also causes ball 10 to bounce slightly. Further, as axle 72 becomes randomly skewed out of a horizontal orientation, the relative differences in rotational accelerations varies resulting in further randomness of both velocity and direction of travel. When combined with the bouncing action, the play value of the toy is greatly enhanced.

The foregoing detailed description has been given for clearness of understanding only, and no unnecessary limitations should be understood therefrom, as modifications will be obvious to those skilled in the art.

I claim:

1. A self-propelled bouncing ball comprising:

(a) a hollow sphere having interlocking first and second hemispheres;

(b) a plurality of spaced apart bounce means joined to and extending outwardly from said hollow sphere; and (c) rotating means featuring self contained drive and off-center mass, said rotating means mounted inside said hollow sphere;

(d) whereby when said rotating means is activated said bouncing ball is caused to leave a support surface to fall back upon one or more of said bounce means causing said ball to rebound in an unexpected direction.

2. The self-propelled bouncing ball of claim 1 further comprising safety means for deactivating said rotating means unless said first and second hemispheres are interlocked.

3. The self-propelled bouncing ball of claim 1 further comprising a safety switch to deactivate said rotating means unless said first and second hemispheres are interlocked.

4. The self-propelled bouncing ball of claim 1 further comprising a safety switch and a power switch which must both be closed to activate said rotating means.

5. The self-propelled bouncing ball of claim 1 in which said rotating means rotates about a fixed axle to propel said ball.

6. The self-propelled bouncing ball of claim 1 in which said rotating means has a center of gravity offset from a fixed axle and said rotating means rotates about said fixed axle.

7. The self-propelled bouncing ball of claim 1 in which said rotating means rotates about a fixed axle and said rotating means comprises:

(a) a battery-powered motor;
(b) a drive shaft rotatably joined to said motor;
(c) a drive gear fixed to said drive shaft;
(d) a large transmission gear meshed with said drive gear;
(e) a small transmission gear fixed coaxially to said large transmission gear; and
(f) a stationary gear fixed to said axle, said stationary gear meshed with said small transmission gear.

8. The self-propelled bouncing ball of claim 1 in which said hollow sphere is rigid.

9. The self-propelled bouncing ball of claim 1 in which said bounce means are sized and spaced to prevent said sphere from contacting a flat supporting surface.

10. The self-propelled bouncing ball of claim 1 in which said bounce means are made of rotational molded poly-vinyl chloride.

11. The self-propelled bouncing ball of claim 1 in which said bounce means are made of a material having a durometer resiliency in the range of Shore A 60–65.

12. The self-propelled bouncing ball of claim 1 in which said bounce means are in the shape of truncated cones.

13. The self-propelled bouncing ball of claim 1 in which said hollow sphere is semi-rigid with a resilient covering.

14. A self-propelled bounding ball comprising:

(a) a hollow sphere having interlocking first and second hemispheres;
(b) a plurality of spaced apart bounce means joined to and extending outwardly from said hollow sphere; and
(c) a fixed axle having first and second ends fixed to said first hemisphere near where said first hemisphere interlocks with said second hemisphere;
(d) an electric motor rotationally mounted on said axle and spaced apart from said first end of said axle, said axle motor featuring an off-center mass;
(e) drive means for rotating said motor about said axle; and
(f) safety means for deactivating said electric motor, said safety means positioned between said axle first end and said electric motor;
(g) whereby when said electric motor is activated said bouncing ball is caused to leave a support surface to fall back upon one or more of said bounce means causing said ball to rebound in an unexpected direction.

15. The self-propelled bouncing ball of claim 14 in which said safety means comprises a normally open switch.

16. The self-propelled bouncing ball of claim 14 in which said safety means comprises a normally open switch which is closed when said first and second hemispheres are interlocked.

17. The self-propelled bouncing ball of claim 14 in which said electric motor has a center of gravity offset from said fixed axle.

18. The self-propelled bouncing ball of claim 14 in which said drive means comprises:

(a) a drive shaft rotatably joined to said motor;
(b) a drive gear fixed to said drive shaft;
(c) a large transmission gear meshed with said drive gear;
(d) a small transmission gear fixed coaxially to said large transmission gear; and
(e) a stationary gear fixed to said axle and meshed with said small transmission gear.

19. The self-propelled bouncing ball of claim 14 in which said hollow sphere is rigid.

20. The self-propelled bouncing ball of claim 14 in which said bounce means are sized and spaced to prevent said sphere from contacting a flat supporting surface.

21. The self-propelled bouncing ball of claim 14 in which said bounce means are made of rotational molded poly-vinyl chloride.

22. The self-propelled bouncing ball of claim 14 in which said bounce means are made of a material having a durometer resiliency in the range of Shore A 60–65.

23. The self-propelled bouncing ball of claim 14 in which said bounce means are in the shape of truncated cones.

24. The self-propelled bouncing ball of claim 14 in which said hollow sphere is semi-rigid with a resilient covering.

25. A self-propelled bounding ball comprising:

(a) a hollow sphere having interlocking first and second hemispheres;
(b) a plurality of spaced apart bounce means joined to and extending outwardly from said hollow sphere;
(c) an axle having first and second ends fixed to said first hemisphere near where said second hemisphere interlocks with said first hemisphere;
(d) an electric motor rotationally mounted on said axle and spaced apart from said first end of said axle, said electric motor featuring an off-center mass;
(e) drive means for rotating said motor about said axle;
(f) a moveable spring contact in communication with said electric motor, said moveable spring contact having a first position to deactivate said electric motor, and a second position to enable said electric motor to be activated; and
(g) means for depressing said moveable spring contact between said first and second positions, said means being slidably mounted on said axle between said first axle end and said electric motor;
(h) whereby when said electric motor is activated said bouncing ball is caused to leave a support surface to fall back upon one or more of said bounce means causing said ball to rebound in an unexpected direction.

26. The self-propelled bouncing ball of claim 25 in which said drive means comprises:

(a) a drive shaft rotatably joined to said motor;

(b) a drive gear fixed to said drive shaft;

(c) a large transmission gear meshed with said drive gear;

(d) a small transmission gear fixed coaxially to said large transmission gear; and (e) a stationary gear fixed to said axle and meshed with said small transmission gear.

27. The self-propelled bouncing ball of claim 25 in which said hollow sphere is rigid.

28. The self-propelled bouncing ball of claim 25 in which said bounce means are sized and spaced to prevent said sphere from contacting a flat supporting surface.

29. The self-propelled bounding ball of claim 25 in which said bounce means are made of rotational molded poly-vinyl chloride.

30. The self-propelled bouncing ball of claim 25 in which said bounce means are made of a material having a durometer resiliency in the range of Shore A 60–65.

31. The self-propelled bounding ball of claim 25 in which said bounce means are in the shape of truncated cones.

32. A self-propelled bounding ball comprising:

(a) a hollow sphere having interlocking first and second hemispheres;

(b) a plurality of spaced apart resilient knobs joined to and extending outwardly from said hollow sphere;

(c) an axle having first and second ends fixed to said first hemisphere near where said second hemisphere interlocks with said first hemisphere;

(d) an electric motor rotationally mounted on said axle and spaced apart from said first end of said axle, (e) drive means for rotating said motor about said axle;

(f) a moveable spring contact in communication with said electric motor, said moveable spring contact having a first position to deactivate said electric motor, and a second position to enable said electric motor to be activated; and (g) means for depressing said moveable spring contact between said first and second positions, said means being slidably mounted on said axle between said first axle end and said electric motor;

said means for depressing said spring contact comprises:

(i) a coil spring slidably mounted on said axle, adjacent said electric motor; and (ii) a cylinder slidably mounted on said axle between said coil spring and said first end of said axle, said cylinder is capable of assuming first and second positions.

33. The self-propelled bouncing ball of claim 32 further comprising tab means for moving said cylinder between said first and second positions, said tab means joined to said second hemisphere.

34. The self-propelled bouncing ball of claim 32 further comprising tab joined to said second hemisphere for maintaining said cylinder to said second position when said first and second hemispheres are interlocked.

* * * * *